US006771055B1

(12) United States Patent
Bell

(10) Patent No.: US 6,771,055 B1
(45) Date of Patent: Aug. 3, 2004

(54) BANDGAP USING LATERAL PNPS

(75) Inventor: Marshall J. Bell, Chandler, AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 10/272,215

(22) Filed: Oct. 15, 2002

(51) Int. Cl.[7] ..... G05F 3/16
(52) U.S. Cl. ..... 323/315; 327/539
(58) Field of Search ..... 323/313, 314, 323/315, 316, 317; 327/535, 538, 539

(56) References Cited

U.S. PATENT DOCUMENTS 5,796,244 A * 8/1998 Chen et al. ..... 323/313
6,181,196 B1 1/2001 Nguyen ..... 327/539
6,232,756 B1 * 5/2001 Kurihara ..... 323/313
6,294,902 B1 * 9/2001 Moreland et al. ..... 323/268
6,529,066 B1 * 3/2003 Guenot et al. ..... 327/539
6,630,859 B1 * 10/2003 Wang ..... 327/539

* cited by examiner

*Primary Examiner*—Matthew V. Nguyen
(74) *Attorney, Agent, or Firm*—Brett A. Hertzberg; Merchant & Gould P.C.

(57) ABSTRACT

Many modern CMOS processes are capable of drawing submicron gate lengths and can be used to produce lateral PNP transistors that have betas within a useful range. A bandgap voltage reference circuit is formed in a standard CMOS process and has lateral PNP transistors that are arranged to provide a ΔVBE reference. A vertical PNP transistor is arranged to provide a VBE reference. The vertical PNP transistor can be relatively large, which reduces the effects of undesirable variances in manufacturing processes. The vertical PNP transistor can be relatively large because it does not affect the ratio of the lateral PNP transistors that are arranged to provide the ΔVBE reference. The problem of offset voltages in the differential amplifier is made moot by applying the offset voltage, if any, to the ΔVBE reference.

26 Claims, 2 Drawing Sheets

200

M28
W=6u L=2u m=4
BIASC
VREF
Msu1
W=1u L=100u
N4
Msu2
W=1u L=2u
Msu3
W=1u L=2u
230
M26
W=6u L=2u m=2
M20
W=6u L=2u m=4
222
Q22
1
INP
TAIL
Q21
48
INN
226
M24
M22
W=6u L=2u m=4
M21
W=6u L=2u m=4
224
M23
W=6u L=2u m=4
220
N2
BIASP
C21
1pF
R23 5K
M25
W=6u L=2u m=2
M27
W=6u L=2u m=4
R21
50K
R22
10K
VBE
Q23
1
210
AVDD
AVSS
+
$K\Delta V_{BE}$
-
+
$V_{PTAT}$
-
+
$\Delta V_{BE}$
-
+
$V_{BE}$
-

BANDGAP USING LATERAL PNPS

FIELD OF THE INVENTION

The present invention relates generally to voltage reference circuits, and more particularly to CMOS bandgap voltage reference circuits.

BACKGROUND OF THE INVENTION

Most CMOS bandgap circuits use a variation of the Brokaw topology, an example of which is shown in FIG. 1. FIG. 1 is a schematic of a conventional Brokaw bandgap voltage reference circuit (100). Circuit 100 is subject to undesirable variances in the offset voltage of the inputs for the operational amplifier. In CMOS processes the offset voltage can be on the order of 10 mV. Such large voltage offsets can result even if the input devices are drawn to large scales on the order of 100 $\mu$m. The ratio of transistor Q2 to Q1 can be made large, but this would result in a ΔVBE of only 100 mV. A voltage offset of 10 mV equates to a 10% error.

A second problem associated with conventional bandgap reference voltages is associated with the size of transistor Q1. Transistor Q1 is typically selected to be relatively small, which results in a desirably large ratio of transistor Q2 to Q1. However, the relatively small size of transistor Q1 typically results in the VBE of the transistor being subject to variances in manufacturing processes. The variances in the VBE undesirably affect the accuracy of the output voltage of bandgap circuit 100.

SUMMARY OF THE INVENTION

According to one aspect of the invention, a CMOS circuit for generating a bandgap voltage reference is provided. The CMOS circuit comprises a first bipolar transistor, an operational amplifier, and a resistive network. The first bipolar transistor is configured to generate a VBE reference. The operational amplifier has a first and a second lateral PNP transistor. The first and second lateral PNP transistors are configured to generate a ΔVBE reference. The resistive network is configured to produce a bandgap voltage reference in response to the generated VBE reference and the generated ΔVBE reference.

According to another aspect of the invention, a method for generating a bandgap voltage in a CMOS circuit comprises generating a VBE reference by using the base-emitter voltage of a first transistor. A ΔVBE reference is generated by using first and second lateral PNP transistors as the input stage of an operational amplifier. The bandgap voltage reference is produced in response to the generated VBE reference and the generated ΔVBE reference.

A more complete appreciation of the present invention and its improvements can be obtained by reference to the accompanying drawings, which are briefly summarized below, to the following detailed description of illustrated embodiments of the invention, and to the appended claims.

DETAILED DESCRIPTION OF THE PREFERRED EMBODIMENT

Figure 1:
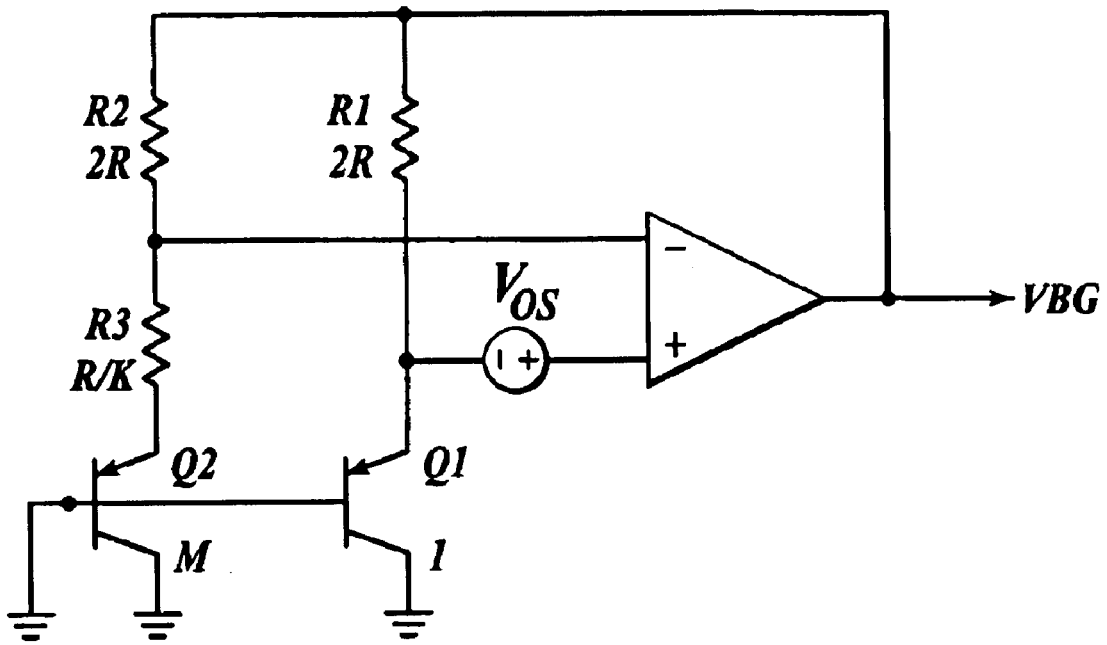
Fig. 1. (PRIOR ART)
FIG. 1 is a schematic of a conventional Brokaw bandgap voltage reference circuit.

In the following detailed description of exemplary embodiments of the invention, reference is made to the accompanied drawings, which form a part hereof, and which is shown by way of illustration, specific exemplary embodiments of which the invention may be practiced. These embodiments are described in sufficient detail to enable those skilled in the art to practice the invention, and it is to be understood that other embodiments may be utilized, and other changes may be made, without departing from the spirit or scope of the present invention. The following detailed description is, therefore, not to be taken in a limiting sense, and the scope of the present invention is defined only by the appended claims.

Throughout the specification and claims, the following terms take the meanings explicitly associated herein, unless the context clearly dictates otherwise. The meaning of "a," "an," and "the" includes plural reference, the meaning of "in" includes "in" and "on." The term "connected" means a direct electrical connection between the items connected, without any intermediate devices. The term "coupled" means either a direct electrical connection between the items connected, or an indirect connection through one or more passive or active intermediary devices. The term "circuit" means either a single component or a multiplicity of components, either active and/or passive, that are coupled together to provide a desired function. The term "signal" means at least one current, voltage, or data signal. Referring to the drawings, like numbers indicate like parts throughout the views.

Many modern CMOS processes are capable of drawing submicron gate lengths and can be used to produce lateral PNP transistors that have betas within a useful range. The present invention is directed towards a bandgap voltage reference circuit that is formed in a standard CMOS process and that has lateral PNP transistors that are arranged to provide a ΔVBE reference. A vertical PNP transistor is arranged to provide a VBE reference. The vertical PNP transistor can be relatively large, which reduces the effects of undesirable variances in manufacturing processes. The vertical PNP transistor can be relatively large because it does not affect the ratio of the lateral PNP transistors that are arranged to provide the ΔVBE reference. The problem of offset voltages in the differential amplifier is made moot by applying the offset voltage, if any, to the ΔVBE reference.

Figure 2:
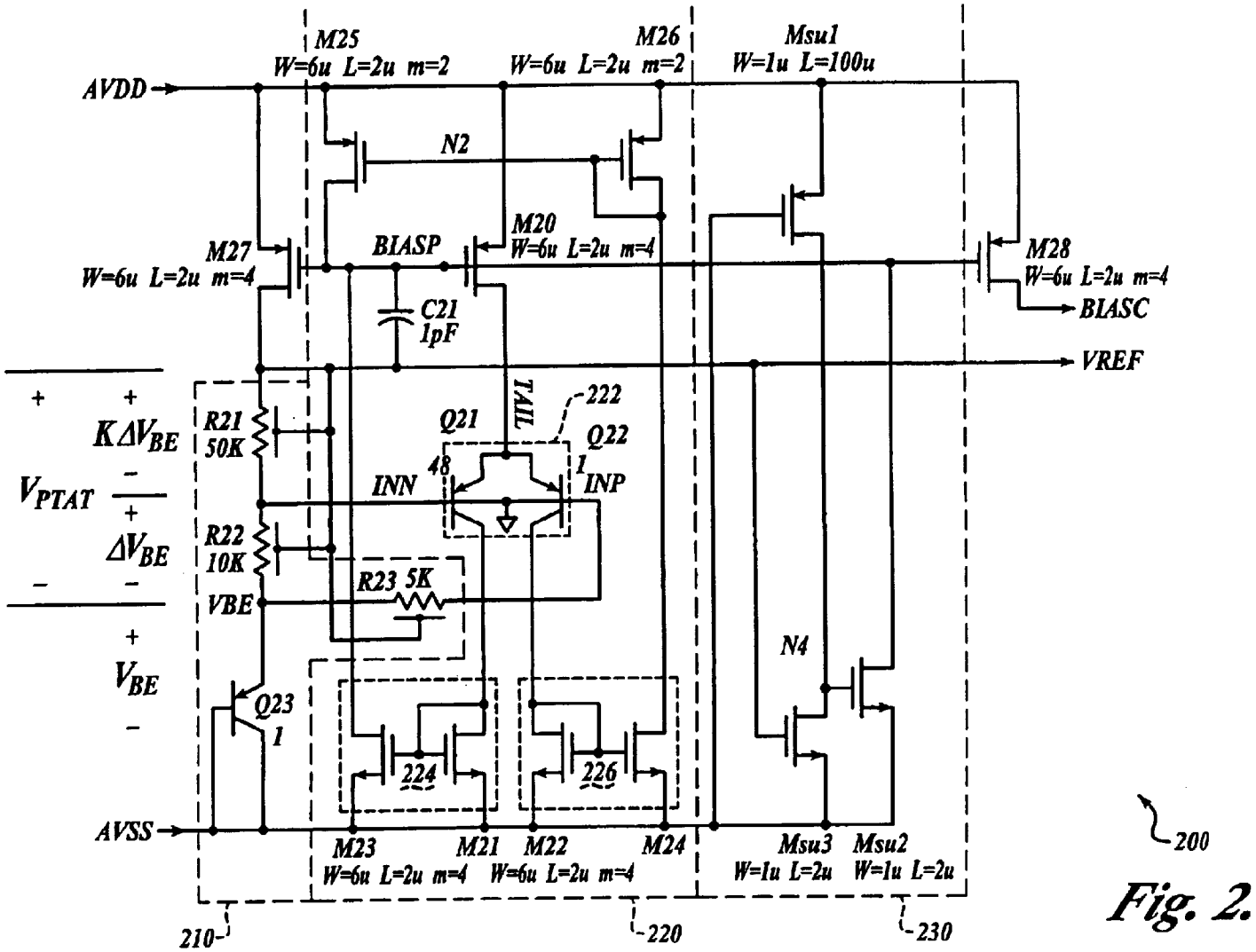
FIG. 2 is a schematic of an example bandgap voltage reference having lateral PNP transistors in a standard CMOS process in accordance with the present invention.

FIG. 2 is a schematic of an example bandgap voltage reference having lateral PNP transistors in a standard CMOS process in accordance with the present invention. Reference circuit 200 includes ΔVBE generator 210, amplifier 220, start circuit 230, gain transistor M27, and bias current transistor M28. ΔVBE generator 210 comprises resistors R21–R23 and transistor Q23. Amplifier 220 comprises transistors M20–M26, transistors Q21 and Q22, and Miller compensation capacitor C21. Transistors Q21 and Q22 are arranged as differential input pair 222. Transistors M21 and M23 are arranged as current mirror 224. Transistors M22 and M24 are arranged as current mirror 226.

Briefly stated, startup circuit 230 is configured to properly initialize ΔVBE generator 210 and amplifier 220. ΔVBE generator 210 is configured to generate a ΔVBE signal. Amplifier 220 is configured to provide a reference signal in response to the delta VBE signal. Gain transistor M27 is arranged (with ΔVBE generator 210) as an inverting gain stage. Gain transistor M27 produces a bandgap reference voltage (VREF) in response to the output of amplifier 220. Bias current transistor M28 reflects the current conducted by gain transistor M27 to provide a current output that is useful for biasing other circuits.

ΔVBE generator 210 comprises transistor Q23, which is arranged to produce a VBE reference. ΔVBE generator 210 also comprises a resistive network formed by resistor R21–R23. In an example embodiment, $P^+$ implant resistors are selected due to their high sheet resistance and slightly better absolute accuracy with respect to polysilicon resistors. The resistors are formed in wells that are coupled to VREF (i.e., the bandgap reference voltage), which minimizes VDD supply dependency.

A VPTAT is developed across resistors R21 and R22. In an example CMOS process, a VPTAT of 631 mV is developed when the initial current is 10 $\mu$A and the initial temperature is 27° C. A KΔVBE is developed across resistor R21, and a ΔVBE is developed across resistor R22 (as described below). The resistor ratio of R21/R22 is determined by the equation $$\frac{R21}{R22} = \frac{VPTAT}{\Delta VBE} - 1$$

which yields a ratio of 5:1 for an example embodiment.

Amplifier 220 comprises differential input pair 222. Transistors Q21 and Q22 of differential input pair 222 are lateral PNP transistors formed in a standard CMOS process. In the example embodiment, a ratio of 48:1 was selected. This ratio allows a 7 by 7 array of transistors to be used. The center transistor of the array is used to implement transistor Q21, while the surrounding transistors are used to form transistor Q22. Using unit transistors allows the error of the ΔVBE to be minimized because of the matching characteristics of the unit transistors.

Amplifier 220 also comprises transistors M20–M26. Transistors M20–M26 are configured as an operational amplifier. The operational amplifier uses the lateral PNPs of differential input pair 222 as an input stage. The base-emitter voltage of transistor Q22 is used to generate the ΔVBE for the bandgap reference.

In operation, startup circuit 230 initializes ΔVBE generator 210 and amplifier 220. Initially, amplifier 220 is stable in a zero current condition. No current flows through transistor M27 because the voltage at node BIASP is high. Transistor Q23 pulls down the voltage of VREF because no current is flowing through transistor M27. Transistor MSU3 does not conduct when VREF is low. Transistor MSU1 is a "long" device and functions resistively. Transistor MSU2 conducts in response to a voltage present at the drain of transistor MSU1, which draws current from node BIASP. Amplifier 210 produces a current at node TAIL in response to the current at node BIASP. VREF rises in response to the current in amplifier 210. Transistor MSU2 is deactivated when VREF rises above an NMOS threshold. Voltages are developed at nodes INN and INP when VREF rises.

Transistor M20 provides a tail current (at node TAIL) in response to the current at node BIASP that is initiated during startup. Differential input pair 222 divides the tail current in response to the voltages at nodes INN and INP. The collector-base voltage of transistors Q21 and Q22 are equal and near zero. Current mirrors 224 and 226 drive comparable currents into transistors M25 and M26, respectively, in response to the collector currents of transistors Q21 and Q22. The current flowing between the drains of transistors M25 and M23 influences the voltage at node BIASP, which provides a feedback path.

In response to the feedback path, transistors Q21 and Q22 drive current until equilibrium is reached. At equilibrium the collector currents of transistors Q21 and Q22 are equal and the potential difference between nodes INN and INP is:

$$INN - INP = \Delta V_{BE} = V_T \ln\left(\frac{I_{C2}}{A_2} \times \frac{A_1}{I_{C1}}\right)$$

where $A_1$ is the area of transistor Q21, $A_2$ is the area of transistor Q22, $I_{C2}$ is the collector current of Q22, $I_{C1}$ is the collector current of Q21, and $$V_T = \frac{KT}{q}$$

Simplifying:

$$INN - INP = V_T \ln\left(\frac{A_1}{A_2}\right)$$

The output reference voltage is then:

$$VREF = \Delta V_{BE}\left(1 + \frac{R_{21}}{R_{22}}\right) + V_{BE}$$

Other embodiments of the invention are possible without departing from the spirit and scope of the invention. For example, any startup circuit that is capable of drawing current from node BIASP when VREF is less than the 1.2 volts may be used. Additionally, gain transistor M27 could be configured as an NMOS voltage follower, although reference circuit 100 would only operate down to a supply voltage of around 2.5 volts.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A CMOS circuit for generating a bandgap voltage reference, comprising:

a first bipolar transistor that is configured to generate a VBE reference;

an operational amplifier that has a differential input pair comprising first and second lateral PNP transistors, wherein the first and second lateral PNP transistors have different base-emitter voltages and are configured to generate a ΔVBE reference; and a resistive network that is configured to produce a bandgap voltage reference in response to the generated VBE reference and the generated ΔVBE reference.

2. The circuit of claim 1, wherein the first transistor is a vertical PNP transistor.

3. The circuit of claim 1, wherein the first and second lateral PNP transistors are formed within a two dimensional array of unit transistors.

4. The circuit of claim 3, wherein the first lateral PNP transistor is formed by a unit transistor that is surrounded by unit transistors that are used to form the second lateral PNP transistor.

5. The circuit of claim 1, wherein the resistive network is formed by implants within well structures.

6. The circuit of claim 5, wherein the well structures are coupled to the produced bandgap voltage reference.

7. The circuit of claim 1, wherein the operational amplifier further comprises a capacitor that is configured to enhance the stability of the operational amplifier.

8. A circuit for producing a bandgap voltage reference in a CMOS circuit, comprising:

means for generating a VBE reference;

means for generating a ΔVBE reference, wherein the means comprise first and second lateral PNP transistors that are configured as a differential input pair in an input stage of an operational amplifier, wherein the first and second lateral PNP transistors have different base-emitter voltages; and means for producing a bandgap voltage reference in response to the generated VBE reference and the generated ΔVBE reference.

9. The circuit of claim 8, wherein the means for generating the VBE reference comprise a vertical PNP transistor.

10. The circuit of claim 8, wherein the means for generating the ΔVBE reference comprise lateral PNP transistors that are formed with within a two dimensional array of unit transistors.

11. The circuit of claim 8, wherein the first lateral PNP transistor is arranged as a lateral PNP unit transistor and the second lateral PNP transistor is formed by other lateral PNP unit transistors that surround the first lateral PNP transistor.

12. The circuit of claim 8, wherein the means for producing a bandgap voltage reference comprise well structures that are coupled to the produced bandgap voltage reference.

13. A method for generating a bandgap voltage reference in a CMOS circuit, comprising:

generating a VBE reference by using the base-emitter voltage of a first transistor;

generating a ΔVBE reference by using a first and second lateral PNP transistors as a differential input pair in an input stage of an operational amplifier, wherein the first and second lateral PNP transistors have different base-emitter voltages; and producing a bandgap voltage reference in response to the generated VBE reference and the generated ΔVBE reference.

14. The method of claim 13, wherein the VBE reference is generated by using a vertical PNP transistor.

15. The method of claim 13, wherein the ΔVBE reference is generated by using lateral PNP transistors that are formed with within a two dimensional way of unit transistors.

16. The method of claim 15, wherein the first late PNP transistor is arranged as a lateral PNP unit transistor that is surrounded by other lateral PNP unit transistors that are used to form the second lateral PNP transistor.

17. The method of claim 13, further comprising increasing the accuracy of the resistive network by coupling well structures that are used to form resistors within the resistor network to the produced bandgap voltage reference.

18. The method of claim 13, further comprising increasing the stability of the operational amplifier by coupling a Miller compensation capacitor to the produced bandgap voltage reference.

19. A CMOS circuit for generating a bandgap voltage reference, comprising:

a first resistor circuit that is coupled between a first node and a second node;

a second resistor circuit that is coupled between the second node and a third node;

a third resistor circuit that is coupled between the first node and a fourth node;

a first bipolar transistor that is configured to provide a VBE reference at the first node;

an operational amplifier, comprising:

a first lateral PNP transistor that includes a base that is coupled to the second node, and an emitter that is coupled to a common node, wherein the first lateral PNP has a first base-emitter voltage;

a second lateral PNP transistor that include a base that is coupled to the fourth node and an emitter that is coupled to the common node, wherein the second lateral PNP has a second base-emitter voltage that is different from the second base-emitter voltage; and an output stage that is coupled to at least one of the first and second lateral PNP transistors, wherein the output stage is arranged to provide an output signal to a fifth node; and a gain transistor that includes a control terminal that is coupled to the fifth node and an output terminal that is coupled to the third node, wherein the first and second lateral PNP transistors in the operational amplifier are arranged to generate a ΔVBE signal in the bandgap voltage reference without the use of additional bipolar devices.

20. The CMOS circuit of claim 19, wherein the output stage of the operational amplifier comprises:

a first current mirror circuit that includes a first terminal that is coupled to a collector of the first lateral PNP transistor and a second terminal that is coupled to the fifth node;

a second current mirror circuit that includes a first terminal that is coupled to a collector of the second lateral PNP transistor and a second terminal that is coupled to a sixth node;

a first MOS transistor that includes a gate that is coupled to the sixth node and a drain that is coupled to the fifth node; and a second MOS transistor that includes a gate and a drain that are coupled to the sixth node.

21. The CMOS circuit of claim 19, wherein the first lateral PNP transistor and the second lateral PNP transistor have different associated areas.

22. The CMOS circuit of claim 19, wherein the first lateral PNP transistor and the second lateral PNP transistor are configured to operate with different current densities.

23. The CMOS circuit of claim 19, wherein at least one of the first lateral PNP transistor and the second lateral PNP transistor comprises an array of lateral PNP transistors that are coupled together in parallel with one another.

24. The CMOS circuit of claim 19, wherein the transistor is at least one of a bipolar junction transistor, a junction field effect transistor, and a metal oxide semiconductor field effect transistor.

25. The CMOS circuit of claim 19, wherein the first bipolar transistor is at least one of a lateral PNP transistor and a vertical PNP transistor.

26. The CMOS circuit of claim 19, further comprising a bias current transistor that includes a control terminal that is coupled to the fifth node and an output terminal that is arranged to provide a current output for use by additional circuitry.

* * * * *